US007989130B2

(12) United States Patent
Hasegawa et al.

(10) Patent No.: US 7,989,130 B2
(45) Date of Patent: Aug. 2, 2011

(54) ELECTROSTATIC LATENT IMAGE DEVELOPING TONER, MANUFACTURING METHOD FOR ELECTROSTATIC LATENT IMAGE DEVELOPING TONER, ELECTROSTATIC LATENT IMAGE DEVELOPING DEVELOPER, AND IMAGE FORMING METHOD

(75) Inventors: Toshiaki Hasegawa, Minamiashigara (JP); Yasunobu Kashima, Minamiashigara (JP); Takeshi Iwanaga, Minamiashigara (JP); Hiroyoshi Okuno, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 964 days.

(21) Appl. No.: 11/298,613

(22) Filed: Dec. 12, 2005

(65) Prior Publication Data

US 2007/0020541 A1 Jan. 25, 2007

(30) Foreign Application Priority Data

Jul. 25, 2005 (JP) ..... 2005-215092

(51) Int. Cl.
*G03G 9/083* (2006.01)

(52) U.S. Cl. ..... 430/106.1; 430/108.4; 430/109.1; 430/109.3; 430/124.1; 430/137.14

(58) Field of Classification Search ..... 430/106.1, 430/108.4, 109.1, 109.3, 124.1, 137.14
See application file for complete search history.

(56) References Cited

U.S. PATENT DOCUMENTS

| | | | | |
|---|---|---|---|---|
| 4,485,163 | A * | 11/1984 | Miyakawa | 430/122.51 |
| 5,460,915 | A * | 10/1995 | Nakanishi et al. | 430/108.4 |
| 2003/0194628 | A1 * | 10/2003 | Yoshida et al. | 430/108.23 |
| 2003/0211414 | A1 * | 11/2003 | Kohtaki et al. | 430/108.4 |
| 2004/0058261 | A1 * | 3/2004 | Fujii et al. | 430/108.4 |
| 2004/0058266 | A1 * | 3/2004 | Matsumura et al. | 430/109.2 |
| 2005/0026061 | A1 * | 2/2005 | Mikuriya et al. | 430/108.1 |

FOREIGN PATENT DOCUMENTS

| | | |
|---|---|---|
| EP | 1480088 | * 11/2004 |
| JP | A 2004-287153 | 10/2004 |

* cited by examiner

*Primary Examiner* — Mark F Huff
*Assistant Examiner* — Rachel L Zhang
(74) *Attorney, Agent, or Firm* — Oliff & Berridge, PLC

(57) ABSTRACT

The present invention provides an electrostatic latent image developing toner including a binding resin having an acidic polar group, a magnetic powder, and a carboxylic acid group-containing compound, the toner having a shape factor (SF1) of 110 to 140, wherein the carboxylic acid group-containing compound has a weight-average molecular weight of 1800 to 50,000 and an acid value of 150 to 600 mg KOH/g.

11 Claims, No Drawings

ELECTROSTATIC LATENT IMAGE DEVELOPING TONER, MANUFACTURING METHOD FOR ELECTROSTATIC LATENT IMAGE DEVELOPING TONER, ELECTROSTATIC LATENT IMAGE DEVELOPING DEVELOPER, AND IMAGE FORMING METHOD

CROSS-REFERENCE TO RELATED APPLICATION

This application claims priority under 35 USC 119 from Japanese Patent Application No. 2005-215092, the disclosure of which is incorporated by reference herein.

BACKGROUND OF THE INVENTION

1. Field of the Invention

The present invention relates to an electrostatic latent image developing toner which is used in developing a latent image formed by electrophotography, electrostatic recording method, or the like, with a developer, a manufacturing method for an electrostatic latent image developing toner, an electrostatic latent image developing developer and an image forming method.

2. Description of the Related Art

In electrophotography, an electrostatic latent image is formed on a photoreceptor by a charging process and an exposure process, and the electrostatic latent image is developed with a developer comprising an electrostatic latent image developing toner (which hereafter may be simply called a "toner"), and visualized through a transfer process and a fixing process. The developer is available as a two-component developer which consists of a toner and a carrier, or as a one-component developer which uses either a magnetic toner or a non-magnetic toner alone. For manufacturing the toner, a so-called kneading and pulverizing method is generally used in which a thermoplastic resin is fused and kneaded together with a pigment, a charge control agent, and a release agent such as a wax or the like, then cooled, pulverized, and further classified.

In recent years, it has been demanded that the image formed by an image forming apparatus using electrophotography has a higher quality, the process have a higher speed, and from the viewpoint of environmental consideration, the production process consume less energy. To meet the demand for higher-quality image, how to make the toner particle size smaller has been investigated; to satisfy the demand for higher-speed process, the low-temperature fixability has been researched; and to accommodate the demand for low energy consumption, improvement of the production method has been vigorously studied.

However, with respect to the conventional toner obtained by the kneading and pulverizing method as mentioned above, there is a limitation in controlling the particle diameter of the toner, and it has been practically difficult to manufacture a toner having a volume-average particle diameter of 6 μm or smaller with a good yield and a narrow particle size distribution. Further, it has been difficult to avoid the disadvantages that, when a toner having a small particle diameter is charged, the variation in charge is great; that fogging is generated on an image formed by the image forming apparatus; that, when image formation is carried out, the toner is scattered, resulting in the inside of the image forming apparatus being fouled with the toner; and the like.

Against these problems, as means for allowing the toner particle diameter and the particle size distribution to be intentionally controlled, methods for manufacturing the toner for electrophotography based on the wet type manufacturing methods, such as the suspension granulation method, the suspension polymerization method, the emulsification polymerization aggregation method, and the like, have been proposed in recent years.

By chemically manufacturing toner particles with these methods, it has become possible to supply a toner with a volume-average particle diameter of 6 μm or less to the market at low cost, which has been actually impossible with the conventional kneading and pulverizing manufacturing method. In addition, when using the conventional kneading and pulverizing manufacturing method, the particle size distribution of the small-diameter toner is broad, and the number of toner particles required per unit area is increased, whereby the charging control of the toner has been difficult, but the wet type manufacturing method has allowed the particle size distribution to be made uniform and the charging control to be facilitated. In such a situation, the demand for higher image quality on the basis of the small particle diameter toner manufactured by the wet type method has been more and more increased.

However, when, in these wet type manufacturing methods, a magnetic toner comprising a magnetic powder to be used for a magnetic 1-component developer or a magnetic 1.5-component developer is manufactured, an excellent particle diameter controllability is provided, but the difference in specific gravity between the magnetic power and the resin particle causes the nonuniform mixing, resulting in a variation in the content of magnetic powder from one toner particle to another, and resulting in a magnetic powder exposed on the toner surface, which have caused problems such that the charge quantity distribution is broadened, and apparatus internal contamination and paper fogging take place.

Then, a prescription of the solubility of the magnetic powder into nitric acid aqueous solution, and a treatment by use of a dispersing agent have been proposed (as disclosed in, for example, Japanese Patent Application Laid-Open No. 2004-287153).

However, when, in the development method using a magnetic toner, the transportability of the toner on the magnet roll in the development apparatus is improved, or the coloring of the toner is improved in order to reduce the amount of the toner consumption, it is necessary to increase the addition amount of the magnetic powder. At this time, if the addition amount of the magnetic powder is over 50% by mass, the dispersion of the magnetic powder in the toner is insufficient, which has caused problems such that a reduction in toner charge quantity or a degradation of the charge quantity distribution is occurred, and an apparatus internal contamination and paper fogging take place.

Especially, in the emulsification polymerization aggregation method, it is necessary that the dispersion liquid be uniformly stirred at the time of the aggregation for the uniform aggregation, however, the difference in specific gravity between the magnetic power and the resin particle prevents uniform mixing, resulting in a variation in the addition amount of magnetic powder from one toner particle to another, and resulting in exposure of the magnetic powder on the toner surface being increased. As a result, problems have been caused such that the dielectric constant of the toner is decreased, and that the charge quantity under a high-temperature high-humidity environment is extremely lowered.

Thus, when, in the wet type manufacturing methods, especially in the emulsification polymerization aggregation method, the addition amount of the magnetic powder is increased, it is required that the dispersion liquid be uniformly mixed while the magnetic powder precipitation being prevented.

SUMMARY OF THE INVENTION

The present invention has been made in view of the above circumstances and provides an electrostatic latent image developing toner in which the magnetic powder is uniformly dispersed and which is excellent in charging characteristics and image stability, a manufacturing method thereof, an electrostatic latent image developing developer, and an image forming method.

A first aspect of the invention provides an electrostatic latent image developing toner comprising a binding resin having an acidic polar group, a magnetic powder, and a carboxylic acid group-containing compound, the toner having a shape factor (SF1) of 110 to 140, wherein the carboxylic acid group-containing compound has a weight-average molecular weight of 1800 to 50,000 and an acid value of 150 to 600 mg KOH/g.

A second aspect of the invention provides a manufacturing method for an electrostatic latent image developing toner comprising at least: an aggregation step of aggregating a mixed liquid containing at least a magnetic powder-containing gelated product and a dispersion liquid of resin particles to form an aggregate, wherein the gelated product is obtained by dispersing a magnetic powder with a carboxylic acid group-containing compound followed by gelating, and the dispersion liquid contains a binding resin having an acidic polar group; and a fusion step of fusing the aggregate by heating at a temperature equal to or greater than the glass transition point of the binding resin, wherein the carboxylic acid group-containing compound has a weight-average molecular weight of 1800 to 50,000 and an acid value of 150 to 600 mg KOH/g.

A third aspect of the invention provides an electrostatic latent image developing developer comprising a toner, wherein the toner is the electrostatic latent image developing toner of the first aspect.

A fourth aspect of the invention provides an image forming method comprising the steps of forming an electrostatic latent image on the surface of an electrostatic latent image carrier; developing the formed electrostatic latent image with an electrostatic latent image developer to form a toner image; transferring the formed toner image onto the surface of a recording medium; and thermally fixing the transferred toner image, wherein the electrostatic latent image developer is the electrostatic latent image developing developer of the third aspect.

DETAILED DESCRIPTION OF THE INVENTION

<Electrostatic Latent Image Developing Toner>

The electrostatic latent image developing toner of the present invention (which hereafter may be called "the toner of the present invention") contains a binding resin having an acidic polar group, a magnetic powder, and a carboxylic acid group-containing compound, and has a shape factor (SF1) of 110 to 140, wherein the carboxylic acid group-containing compound has a weight-average molecular weight of 1800 to 50,000 and an acid value of 150 to 600 mg KOH/g.

The toner of the present invention is preferably manufactured by a wet type method as described later. An emulsification polymerization aggregation method, in which a binding resin is manufactured by emulsification-polymerization and is hetero-aggregated together with a dispersion liquid containing a magnetic powder (gelated product), a coloring agent, a release agent, and the like followed by fusion and coalescence thereof, is more preferable from the viewpoint of being excellent in toner particle diameter controllability, narrow particle size distribution, shape controllability, narrow shape distribution, internal dispersion controllability, and the like. However, a wet type manufacturing method comprising other aggregation process or fusion process may be adopted, and thus the method used in the invention is not limited to the emulsification polymerization aggregation method as mentioned above.

When the toner of the present invention is manufactured by the emulsification polymerization aggregation method, the binding resin particles in the aggregated particles are fused at a temperature equal to or higher than the glass transition temperature of the binding resin in the fusion process after the aggregation process, and the shape of the aggregated particles is gradually changed from an amorphous one to a spherical one. At this time, the shape of the aggregated particles, which is amorphous, is becoming spherical by coalescence, and at the stage where a desired shape is obtained, the heating of the toner is stopped followed by cooling, cleaning, and drying to form the toner particles.

The toner of the present invention has a shape factor (SF1) in the range of 110 to 140, and more preferably in the range of 120 to 135. If the SF1 is under 110, the cleanability may not be assured, and if the SF1 exceeds 140, the transferability may be degraded.

The shape factor (SF1) of the toner in the present invention is the average value of the shape factors that are determined by taking the optical microscope image of the 500 or more toner particles scattered on a slide glass into a Luzex image analyzing apparatus through a video camera, and using the following formula:

$$\text{Shape factor } (SF1)=(ML^2/A)\times(\pi/4)\times 100$$

(ML denotes the circumferential length of the toner, and A the projected area.)

When the toner of the present invention is manufactured by the hetero aggregation method such as the emulsification-aggregation method, the magnetic powder to be used is first dispersed into water. As the dispersing agent, a carboxylic acid group-containing compound which has a weight-average molecular weight of 1800 to 50,000 and an acid value of 150 to 600 mg KOH/g (which hereinafter may be called "the carboxylic acid group-containing compound pertaining to the invention") is added to disperse the magnetic powder, and then the dispersion liquid is rendered acidic for gelation.

As described above, by adding the carboxylic acid group-containing compound pertaining to the invention to disperse the magnetic powder followed by rendering the dispersion liquid acidic for gelation, the viscosity of the dispersion liquid in the stirring tank can be increased to suppress precipitation of the magnetic powder and render the mixing uniform. Further, by controlling the aggregation speed, the magnetic powder is uniformly dispersed by the wet type method even if the content of the magnetic powder is 50% or higher by mass of the whole of the toner, and further, a toner, which gives a narrow particle size distribution and in which other additives such as the release agent and the like are uniformly dispersed, can be obtained. In the toner of the present invention, the magnetic powder is uniformly dispersed even if the content of the magnetic powder is 50% or higher by mass of the whole of the toner, thus a good-quality toner which is excellent in charging characteristics and image stability can be obtained.

In addition, the carboxylic acid group-containing compound pertaining to the invention not only is used in the process of dispersing the magnetic powder into water, gelates the magnetic powder dispersion liquid, and facilitates the aggregation of the magnetic powder and the resin particles, but also can change the time required for aggregation, the state of the dispersion system, and the like, in the aggregation process. Therefore, it can control the viscosity at the time of aggregation of the dispersion liquid, and can improve the productivity. In addition, it allows the toner quality, such as the particle size distribution, the shape distribution, and the charging characteristics, and the like, to be well maintained.

The carboxylic acid group-containing compound pertaining to the invention is not particularly limited, provided that it is a compound having a weight-average molecular weight of 1800 to 50,000 and an acid value of 150 to 600 mg KOH/g.

In the present invention, the weight-average molecular weight and the number-average molecular weight of the carboxylic acid group-containing compound pertaining to the invention and the later described binding resin and the like are determined under the following conditions. As the GPC (gel permeation chromatography) apparatus, an HLC-8120GPC, SC-8020 (manufactured by TOSOH CORPORATION) is used; two TSKgel, Super HM-H columns (manufactured by TOSOH CORPORATION, with 6.0 mm ID×15 cm) are used; and as the eluent, THF (tetrahydrofran) is used. As the experimental conditions, a sample concentration of 0.5%, a flow rate of 0.6 ml/min, a sample injection amount of 10 μL, a measuring temperature of 40° C., and an IR detector are used for the experiment. The calibration curve is prepared from ten samples of the TOSOH CORPORATION Polystyrene Standard Sample TSK standards: A-500, F-1, F-10, F-80, F-380, A-2500, F-4, F-40, F-128, and F-700.

As the carboxylic acid group-containing compound pertaining to the invention, examples include an oligomer or a copolymer resin of a monomer having a carboxylic acid group, and their salts. As the monomer having a carboxylic acid group, examples include α,β-ethylene type unsaturated compounds having a carboxylic acid group, and the like. As the α,β-ethylene type unsaturated compound, examples include acrylic acid, methacrylic acid, fumaric acid, maleic acid, itaconic acid, cinnamic acid, monomethyl maleate, maleic acid monobutyl ester, maleic acid monooctyl ester, and the like, and among these, acrylic acid and maleic acid are preferable. As the copolymer resin with a monomer having a carboxylic acid group, examples include styrene-acrylic acid copolymer resin, styrene-acrylic ester-acrylic acid copolymer resin, α-methylstyrene-acrylic acid copolymer resin, styrene-maleic acid copolymer resin, and their salts. A part of these copolymer resins may be esterified.

The carboxylic acid group-containing compound pertaining to the invention essentially have a weight-average molecular weight in the range of 1800 to 50,000; preferably in the range of 2000 to 50,000; and more preferably in the range of 5000 to 20,000. If the weight-average molecular weight of the carboxylic acid group-containing compound pertaining to the invention is lower than 1800, the magnetic powder dispersion liquid is difficult to gelate, which results in the viscosity of the dispersion liquid at the time of the aggregation being lower. If it is higher than 50,000, the gelated magnetic powder dispersion liquid cannot be redispersed.

In addition, the carboxylic acid group-containing compound pertaining to the invention essentially have an acid value in the range of 150 to 600 mg KOH/g; preferably in the range of 200 to 500 mg KOH/g; and more preferably in the range of 250 to 400 mg KOH/g. If the acid value of the carboxylic acid group-containing compound pertaining to the invention is lower than 150 mg KOH/g, the gelation is difficult to cause, and if the acid value is higher than 600 mg KOH/g, the aggregation is difficult to control. In addition, it is difficult to manufacture a carboxylic acid group-containing compound having an acid value higher than 600 mg KOH/g.

The carboxylic acid group-containing compound pertaining to the invention is preferably used as an aqueous alkaline solution; although the solubility varies depending on the acid value and the molecular weight, it is desirable to adjust the viscosity at the time of the dissolution to be 100 to 5000 cps; and it is preferable to adjust the pH value at the time of the dissolution to be 8.0 to 9.5.

The carboxylic acid group-containing compound pertaining to the invention is added in accordance with the concentration of the solid content in the magnetic powder dispersion system at the manufacture, and the amount of the polar group in the binding resin at the time of the aggregation, and the like. The solid content of the carboxylic acid group-containing compound pertaining to the invention based on the solid content of the magnetic powder is preferably 0.5 to 30.0% by mass, and is more preferably 5.0 to 15.0% by mass. If the content of the carboxylic acid group-containing compound pertaining to the invention based on the content of the magnetic powder is less than 0.5% by mass, a sufficient effect may not be obtained, and if it is greater than 30.0% by mass, the aggregation control may be impeded.

As the binding resin to be used in the present invention, examples thereof include thermoplastic resins, and specific examples thereof include homopolymers or copolymers of styrenes (styrene resins) such as styrene, parachlorostyrene, α-methylstyrene; homopolymers or copolymers of esters having a vinyl group (vinyl resins) such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate; homopolymers or copolymers of vinyl nitriles (vinyl resins) such as acrylonitrile, methacrylonitrile; homopolymers or copolymers of vinyl ethers (vinyl resins), such as vinyl ethyl ether, vinyl isobutyl ether; homopolymers or copolymers of vinyl ketones (vinyl resins), such as vinyl methyl ketone, vinyl ethyl ketone, vinyl isopropenyl ketone; homopolymers or copolymers of olefins (olefin resins), such as ethylene, propylene, butadiene, isoprene; non-vinyl condensation resins, such as epoxy resins, polyester resins, polyurethane resins, polyamide resins, cellulose resins, polyether resins, and graft polymers of these non-vinyl condensation resins and vinyl monomers. These resins may be used alone or in combination of two or more types.

In the present invention, it is required that an acidic polar group exist in the binding resin, and as the acidic polar group, carboxylic acid group, sulfone group, phosphate group, formyl group, and the like can be mentioned, and carboxylic acid group is preferable because of being good in shape controllability and charging controllability.

The acidic polar group can be obtained by the process of copolymerizing with a monomer having an acidic polar group; polycondensing or addition polymerizing low molecular weight compounds having an acidic polar group; introducing an acidic polar group into a polymer by a reaction; or the like. As the monomer having an acidic polar group, examples include α,β-ethylene type unsaturated compounds having a carboxyl group, α,β-ethylene type unsaturated compounds having a sulfone group. As the α,β-ethylene type unsaturated compound having a carboxyl group, examples include acrylic acid, methacrylic acid, fumaric acid, maleic acid, itaconic acid, cinnamic acid, monomethyl maleate, maleic acid monobutyl ester, maleic acid monooctyl ester, and among these, acrylic acid and methacrylic acid are preferable.

As the α,β-ethylene type unsaturated compound having a sulfone group, examples include sulfonated ethylene, a salt thereof, allylsulfosuccinic acid, octyl allylsulfosuccinate.

As the low-molecular weight compound having a carboxyl group as an acidic polar group that is used in the polycondensation or addition polymerization, examples include aromatic carboxylic acids, such as terephthalic acid, isophthalic acid, phthalic acid, phthalic anhydride, benzene-1,2,4-tricarboxylic acid, benzene-1,2,5-tricarboxylic acid, naphthalene-2,5,7-tricarboxylic acid, naphthalene-1,2,4-tricarboxylic acid; aliphatic carboxylic acids, such as oxalic acid, malonic acid, succinic acid, glutaric acid, adipic acid, hexahydrophthalic anhydride, itaconic acid, maleic acid, fumaric acid, mesaconic acid, citraconic acid, 1,2,4-butanetricarboxylic acid, hexane-1,2,5-tricarboxylic acid, 1,3-dicarboxylic-2-carboxymethylpropene, 1,3-dicarboxylic-2-methyl-2-carboxymethylpropane, tetra(carboxymethyl)methane, octane-1,2,7,8-tetracarboxylic acid, maleic anhydride; alicyclic carboxylic acids, such as tetrahydrophthalic acid, hexahydrophthalic acid, methyltetrahydrophthalic acid, methylhexahydrophthalic acid, methylhymic acid, trialkyltetrahydrophthalic acid, methylcyclohexenedicarboxylic acid, and their anhydrides.

As the binding resin to be used in the present invention, vinyl resins are particularly preferable among these binding resins. The vinyl binding resins are advantageous in that they allow a resin dispersion liquid to be easily prepared by emulsification-polymerization, seed polymerization, or the like, using an ionic surfactant, or the like.

To the binding resin to be used in the present invention, a crosslinking agent can be added as required.

Specific examples of such crosslinking agent include multivinyl aromatic compounds, such as divinyl benzene, divinyl naphthalene; multivinyl esters of aromatic polycarboxylic acids, such as phthalic acid divinyl, isophthalic acid divinyl, terephthalic acid divinyl, homophthalic acid divinyl, trimesic acid divinyl/trivinyl, naphthalene dicarboxylic acid divinyl, biphenyl carboxylic acid divinyl; divinyl esters of nitrogen-containing aromatic compounds, such as pyridine carboxylic acid divinyl; vinyl esters of unsaturated heterocyclic compound carboxylic acids, such as vinyl pyromucate, vinyl furancarboxylate, vinyl pyrrol-2-carboxylate, vinyl thiophene carboxylate; (meth)acrylic esters of straight-chain polyalcohols, such as butanediolmethacrylate, hexanediolacrylate, octanediolmethacrylate, decanediolacrylate, dodecanediolmethacrylate; (meth)acrylic esters of branched or substituted polyalcohols, such as neopentyl glycol dimethacrylate, 2-hydroxy-1,3-diacryloxypropane; polyethylene glycol di(meth)acrylate, polypropylene polyethylene glycol di(meth)acrylate; multivinyl esters of polycarboxylic acids, such as divinyl succinate, divinyl fumarate, vinyl/divinyl maleate, divinyl diglycolate, vinyl/divinyl itaconate, divinyl aceton dicarbonate, divinyl glutarate, divinyl 3,3'-thiodipropionate, divinyl/trivinyl trans-aconitate, divinyl adipate, divinyl pimelate, divinyl suberate, divinyl azelate, divinyl sebacinate, divinyl dodecanedioate, divinyl brasilate.

In the present invention, these crosslinking agents may be used alone or in combination of two or more types. In addition, among the crosslinking agents mentioned above, in order to avoid excessive viscosity of the binding resin in the state of coalescence, (meth)acrylic esters of straight-chain polyalcohols such as butanediolmethacrylate, hexanediolacrylate, octanediolmethacrylate, decanediolacrylate, dodecanediolmethacrylate; (meth)acrylic esters of branched or substituted polyalcohols such as neopentyl glycol dimethacrylate, 2-hydroxy-1,3-diacryloxypropane; polyethylene glycol di(meth)acrylate, polypropylene polyethylene glycol di(meth)acrylate; and the like, which can inhibit deposition of the release agent on the toner surface when cooling, are preferably used.

The content of the crosslinking agent is preferably 0.05 to 5% by mass of the total amount of the polymerizable monomers to be used for formation of the binding resin, and is more preferably 0.1 to 1.0% by mass.

The binding resin to be used in the present invention can be manufactured by carrying out radical polymerization of the polymerizable monomers.

The radical polymerization initiator to be used herein is not particularly limited. Specific examples thereof include peroxides, such as hydrogen peroxide, acetyl peroxide, cumyl peroxide, tert-butyl peroxide, propionyl peroxide, benzoil peroxide, chlorobenzoil peroxide, dichlorobenzoil peroxide, bromomethylbenzoil peroxide, lauloyl peroxide, ammonium persulfate, sodium persulfate, potassium persulfate, peroxydiisopropyl carbonate, tetralin hydroperoxide, 1-phenyl-2-methylpropyl-1-hydroperoxide, tert-butyl hydroperoxide pertriphenylacetate, tert-butyl performate, tert-butyl peracetate, tert-butyl perbenzoate, tertbutyl perphenylacetate, tert-butyl permethoxyacetate, tert-butyl per-N-(3-toluyl)carbamate; azo compounds, such as 2,2'-azobispropane, 2,2'-dichloro-2,2-azobispropane, 1,1'-azo(methylethyl)diacetate, 2,2'-azobis(2-aminodipropane) hydrochloride, 2,2'-azobis(2-aminodipropane) nitrate, 2,2'-azobis-isobutane, 2,2'-azobis-isobutylamide, 2,2'-azobisisobutylonitrile, methyl 2,2'-azobis-2-methylpropionate, 2,2'-dichloro-2,2'-azobisbutane, 2,2'-azobis-2-methylbutylonitrile, dimethyl 2,2'-azobisisobutylate, 1,1-azobis(1-methylbuthylonitrile-3-sodiumsulfonate), 2-(4-methylphenylazo)-2-methylmalonodinitrile, 4-4'-azobis-4-cyanovaleric acid, 3,5-dihydroxymethylphenylazo-2-methylmalonodinitrile, 2-(4-bromophenylazo)-2-allylmalonodinitril, 2,2-azobis-2-methylvalelonitrile, dimethyl 4,4-azobis-4-cyanovalerate, 2,2'-azobis-2,4-dimethylvaleronitrile, 1,1'-azobiscyclohexanenitrile, 2,2'-azobis-2-propylbutylonitrile, 1,1'-azobis-1-chlorophenyletane, 1,1'-azobis-1-cyclohexanecarbonitrile, 1,1'-azobis-1-cycloheptanenitrile, 1,1'-azobis-1-phenyletane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenyletane, poly(bisphenol A-4,4'-azobis-4-cyanopentanoate), poly(tetraethyleneglycol-2,2'-azobisisobutylate); 1,4-bis(pentaethylene)-2-tetrazene, 1,4-dimethoxycarbonile-1,4-diphenyl-2-tetrazene.

The molecular weight of the binding resin to be used in the present invention may be adjusted by using a chain transfer agent. The chain transfer agent is not particularly limited; specifically a chain transfer agent having a covalent bond between a carbon atom and a sulfur atom is preferable; and more specifically examples thereof include n-alkyl mercaptans, such as n-propyl mercaptan, n-butyl mercaptan, n-amyl mercaptan, n-hexyl mercaptan, n-heptyl mercaptan, n-octyl mercaptan, n-nonyl mercaptan, n-decyl mercaptan; branched-chain alkyl mercaptans, such as isopropyl mercaptan, isobutyl mercaptan, s-butyl mercaptan, tert-butyl mercaptan, cyclohexyl mercaptan, tert-hexadecyl mercaptan, tert-lauryl mercaptan, tert-nonyl mercaptan, tert-octyl mercaptan, tert-tetradecyl mercaptan; aromatic ring-containing mercaptans, such as allyl mercaptan, 3-phenylpropyl mercaptan, phenyl mercaptan, mercaptotriphenyl methane.

The binding resin to be used in the present invention preferably has a glass transition point in the range of 40° C. to 70° C., and more preferably in the range of 45° C. to 60° C. If the glass transition point of the binding resin is lower than 40° C., the toner powder may be easily blocked due to the heat, and if it exceeds 70° C., the fixing temperature may be too high.

In addition, the binding resin to be used in the present invention preferably has a weight-average molecular weight in the range of 6000 to 45,000; when the binding resin is a polyester resin, the weight-average molecular weight thereof is more preferably in the range of 6000 to 10,000; and when the binding resin is a vinyl resin, it is more preferably in the range of 24,000 to 36,000.

If the weight-average molecular weight of the binding resin exceeds 45,000, the viscoelasticity at the time of the fixing is higher, and thus a smooth fixed image surface which is required for high luster may be difficult to obtain; and if the weight-average molecular weight is lower than 6000, the melt viscosity of the toner at the time of the fixing process is lower, the aggregation power being lower, and thus a hot offset may be caused. In addition, when the binding resin is a polyester resin, the weight-average molecular weight exceeding 10,000 may render the dispersion in an aqueous medium difficult.

The binding resin to be used in the present invention preferably has a ratio of the weight-average molecular weight to the number-average molecular weight (Mw/Mn) of 3.3 or lower, and more preferably has a ratio of 2.8 or lower. In order to render the migration of the release agent to the fixed image surface rapid, and to obtain a smooth fixed image surface, moderately low viscosity is advantageous and the binding resin preferably has a narrow molecular weight distribution. If the Mw/Mn is higher than 3.3, the smooth fixed image surface required for high luster may be difficult to obtain.

As the magnetic powder to be used in the present invention, metals such as iron, cobalt, and nickel, and their alloys; metal oxides such as $Fe_3O_4$, $\gamma$-$Fe_2O_3$, and cobalt-added iron oxide; various ferrites such as MnZn ferrite, and NiZn ferrite, magnetite, hematite, and the like, can be used. Further, these substances which surfaces are treated with a surface treatment agent such as a silane coupling agent, or a titanate coupling agent; coated with an inorganic material such as a silicon compound, or an aluminum compound; or polymer-coated, may be used.

The average particle diameter of the magnetic powder is preferably 0.01 to 1.0 μm, and is more preferably 0.01 to 0.5 μm.

By adjusting the average particle diameter of the magnetic powder particles to be in this range, advantages are obtained that the magnetic powder can be better dispersed into the later described aggregated particles; the uneven distribution of the composition among the toner particles can be suppressed; and the non-uniformity of the toner performance and the reliability can be minimized. And, the average particle diameter of 0.5 μm or less can further improve the colorability of the toner and the like.

The average particle diameter can be determined by using, for example, a laser diffraction type particle size distribution measuring apparatus.

The toner of the present invention may further contain a release agent, and generally the release agent preferably has a poor compatibility with the binding resin contained in the toner. If using a release agent which has a high compatibility with the binding resin, the release agent merges into the binding resin, resulting in promotion of the plasticization of the binding resin and lowering of the viscosity of the toner at the time of the high-temperature fixing, whereby an offset may be easily caused.

Specific examples of the release agent include low-molecular weight polyolefines, such as polyethylene, polypropylene, polybutene, and the like; silicones exhibiting a softening point when subjected to heating; fatty acid amides, such as oleamide, erucamide, ricinoleamide, stearamide, and the like; vegetable waxes, such as carnauba wax, rice wax, candelilla wax, Japan wax, jojoba oil, and the like; animal waxes, such as beeswax, and the like; mineral/petroleum waxes, such as Montan wax, ozokerite, ceresine, paraffin wax, microcrystalline wax, Fischer-Tropsh wax, and the like; ester waxes from a higher fatty acid and a higher alcohol, such as stearyl stearate, behenyl behenate, and the like; ester waxes from a higher fatty acid and a monovalent or polyvalent lower alcohol, such as butyl stearate, propyl oleate, glyceride monostearate, glyceride distearate, pentaerythrytol tetrabehenate, and the like; ester waxes consisting of a higher fatty acid and a polyvalent alcohol multimer, such as diethylene glycol monostearate, dipropylene glycol distearate, diglyceride distearate, triglyceride tetrastearate, and the like; sorbitan higher fatty acid ester waxes, such as sorbitan monostearate, and the like; cholesterol higher fatty acid ester waxes, such as cholesteryl stearate, and the like. The degree of crystallization of a release agent can be determined by the X-ray analyzing method.

The content of the release agent in the toner is preferably 6 to 25% by mass, and is more preferably 9 to 20% by mass. If the amount of the release agent is under 6% by mass, the absolute amount of the release agent is insufficient, whereby the fixed image may be migrated to the opposed paper or image due to the heat and pressure, that is, a so-called document offset may be caused. If the amount of the release agent exceeds 25% by mass, the viscoelasticity of the toner fused at the time of the fixing is extremely lowered, which may cause a hot offset or a phenomenon called wax offset. Meanwhile, the wax offset is such that when using an OHP sheet, the release agent will not permeate the OHP sheet, thereby adhering to the fixing roll, so that the release agent remains on another OHP sheet at the second or subsequent cycles of the fixing roll operation.

The toner of the present invention may further contain a coloring agent as a complementary color for adjusting the color tone. The coloring agent is not particularly limited, known coloring agents can be used, and an appropriate one may be selected in accordance with the purpose. The coloring agent may be used alone, or two or more types of coloring agents in the same color family may be used in mixture. In addition, two or more types of coloring agents in different color families may be used in mixture. Further, these coloring agents may be surface treated for use. Specific examples of the coloring agent to be used include the following coloring agents in the black, yellow, red, blue, purple, green, and white color families.

Examples of the black coloring agent include organic and inorganic coloring agents, such as carbon black, aniline black, activated carbon, nonmagnetic ferrite, magnetite, and the like.

Examples of the blue coloring agent include organic and inorganic coloring agents, such as Prussian blue, cobalt blue, alkali blue lake, Victoria blue lake, fast sky blue, induthrene blue BC, ultramarine blue, phthalocyanine blue, phthalocyanine green, and the like.

Examples of the yellow coloring agent include chrome yellow, zinc yellow, yellow iron oxide, cadmium yellow, chrome yellow, fast yellow, fast yellow 5G, fast yellow 5GX, fast yellow 10G, benzidine yellow G, benzidine yellow GR, threne yellow, quinoline yellow, permanent yellow NCG, and the like.

Examples of the orange coloring agent include orange chrome yellow, molybdenum orange, permanent orange GTR, pyrazolone orange, Balcan orange, benzidine orange G, induthrene brilliant orange RK, induthrene brilliant orange GK, and the like.

Examples of the red coloring agent include red oxide, cadmium red, red lead, red mercury sulfide, watchung red, permanent red 4R, lithol red, brilliant carmine 3B, brilliant carmine 6B, Dupont oil red, pyrazolone red, rhodamine B lake, lake red C, rose Bengal, eoxine red, alizarin lake, and the like.

Examples of the purple coloring agent include organic and inorganic coloring agents, such as manganese purple, fast violet B, methyl violet lake, and the like.

Examples of the green coloring agent include organic and inorganic coloring agents, such as chrome oxide, chrome green, pigment green B, malachite green lake, final yellow green G, and the like.

Examples of the white coloring agent include Chinese white, titanium oxide, antimony white, zinc sulfide, and the like.

Examples of the body pigment include Baryte powder, barium carbonate, clay, silica, white carbon, talc, alumina white, and the like.

To the toner of the present invention, additives such as a charge control agent, inorganic particles, organic particles, a lubricant, a polishing agent, and the like can be added as required in addition to the above-mentioned binding resin, the magnetic powder, the carboxylic acid group-containing compound pertaining to the invention, the release agent, and the coloring agent.

As the charge control agent, fluorine surfactants; salicylic acid complexes; iron dyes, such as iron complexes; chrome dyes, such as chromium complexes; polymer acids, such as copolymers containing maleic acid as a monomer component; quaternary ammonium salts; azine dyes, such as nigrosine; and the like can be used.

As the inorganic particles, general external additives to the toner surface, such as silica, titania, calcium carbonate, magnesium carbonate, tricalcium phosphate, cerium oxide, and the like, can be used.

As the organic particles, general external additives to the toner surface, such as vinyl resins, polyester resins, silicone resins, and the like, can be used. These inorganic particles and organic particles can be used as a fluidity auxiliary agent and a cleaning auxiliary agent.

As the lubricant, fatty acid amides, such as ethylene-bis-stearamide, oleamide, and the like; and fatty acid metallic salts, such as zinc stearate, calcium stearate, and the like can be used.

As the polishing agent, silica, alumina, cerium oxide, and the like, can be used.

In addition, these additives may be appropriately added in the range which will not impede the purpose of the present invention, however, the addition amount is generally very small; specifically, it is preferably 0.01 to 5% by mass, and is more preferably 0.01 to 3% by mass.

<Manufacturing Method for an Electrostatic Latent Image Developing Toner>

The manufacturing method for the electrostatic latent image developing toner of the present invention (which hereinafter may be called the manufacturing method for the toner of the invention) is a manufacturing method for an electrostatic latent image developing toner comprising at least: an aggregation step of aggregating a mixed liquid containing at least a magnetic powder-containing gelated product and a dispersion liquid of resin particles to form an aggregate, wherein the gelated product is obtained by dispersing a magnetic powder with a carboxylic acid group-containing compound followed by gelating, and the dispersion liquid contains a binding resin having an acidic polar group; and a fusion step of fusing the aggregate by heating at a temperature equal to or greater than the glass transition point of the binding resin, wherein the carboxylic acid group-containing compound is the above-mentioned carboxylic acid group-containing compound pertaining to the invention.

Specifically, the manufacturing method for the toner of the invention is an emulsification polymerization aggregation method, in which a dispersion liquid of resin particles comprising a binding resin is first prepared by the emulsification-polymerization method, or some other method. On the other hand, a magnetic powder is dispersed with a carboxylic acid group-containing compound and the resulting dispersed liquid is gelated to prepare a magnetic powder-containing gelated product. Then, a dispersion liquid of resin particles is hetero-aggregated together with the magnetic powder-containing gelated product, a coloring agent dispersion liquid, a release agent dispersion liquid, and the like, followed by fusion/coalescence.

The dispersion liquid of resin particles comprises the particles of the above-mentioned binding resin, and the average particle diameter thereof is preferably 1 μm or less, and is more preferably 0.01 to 1 μm. If the average particle diameter exceeds 1 μm, the particle size distribution of the toner particles obtained by the aggregation and fusion may be broadened, or free particles may be generated, leading to degradation of the performance and reliability of the toner. In the present invention, by adjusting the average particle diameter of the resin particles to be in the range of 0.01 to 1 μm, advantages are obtained that the resin particles can be better dispersed into the aggregated particles; the uneven distribution of the composition among the toner particles can be suppressed; and the non-uniformity of the toner performance and the reliability can be minimized. The average particle diameter can be determined by using, for example, a laser diffraction type particle size distribution measuring apparatus, a Coulter counter, or the like.

For manufacturing of the magnetic powder-containing gelated product, the above-mentioned magnetic powder is added to the above-mentioned carboxylic acid group-containing compound pertaining to the invention for dispersing it to obtain a magnetic powder dispersion liquid. The dispersion method to be adopted at this time is not restricted, and any method, such as a rotary shearing type homogenizer, a ball mill with media, a sand mill, Dynomill, or the like can be used.

The average particle diameter of the magnetic powder dispersion particles obtained as described above is preferably 1 μm or less; is more preferably 0.5 μm or less, and is still more preferably 0.01 μm to 0.5 μm. If the average particle diameter of the magnetic powder dispersion particles exceeds 1 μm, the particle size distribution of the electrostatic latent image developing toner finally obtained may be broadened, or free particles may be easily generated, leading to degradation of the performance and reliability of the toner.

The amount of the magnetic powder added is preferably 12 to 70% by mass, and more preferably 50 to 60% by mass.

The carboxylic acid group-containing compound pertaining to the invention may be used as it is when dispersing the magnetic powder, however, it is preferably used as an aqueous solution, and is preferably used as a neutralized solution prepared by dissolving it into a basic aqueous solution such as an aqueous ammonia, an aqueous sodium hydroxide, or the like.

Dispersion of the magnetic powder into the carboxylic acid group-containing compound pertaining to the invention is preferably carried out at a pH of 7 or higher so as to prevent the gelation from progressing, and it is preferable that, after the dispersion, the pH be adjusted to an acidic value with nitric acid or the like for gelation to obtain a magnetic powder containing gelated product. By thus carrying out gelation, not only the precipitation separation of the magnetic powder in the dispersion liquid is prevented, but also the adhesion between the dispersing agent and the magnetic powder is strengthened, which facilitates the aggregation with the resin particles in the aggregation process.

The toner of the present invention may contain a release agent, and in that case, a release agent dispersion liquid containing the particles of the release agent is further added to the mixed solution. The average particle diameter of the particles of the release agent is preferably 1.5 μm or less, and is more preferably 0.1 μm to 1.0 μm. If the average particle diameter of the particles of the release agent exceeds 1.5 μm, the domain diameter of the release agent in the electrostatic latent image developing toner finally obtained may be increased, or free particles may be easily generated, leading to degradation of the performance and reliability of the toner.

The toner of the present invention may contain a coloring agent in order to adjust the color tone, and in that case, the coloring agent can be dispersed into the binding resin by using a known method. For example, by dispersing the coloring agent together with a dispersing agent such as a surfactant or the like into an aqueous medium using a mechanical impact or the like, a coloring agent dispersion liquid can be prepared. This is aggregated together with the resin particles and the like to manufacture the toner particles.

Specific examples of the coloring agent dispersing method using a mechanical impact or the like for preparation of the coloring agent dispersion liquid include methods using a media type dispersing machine such as a rotary shearing type homogenizer, a ball mill, a sand mill, and an attriter, or a high-pressure counter-collision type dispersing machine.

In order to assure the coloring in fixing, the coloring agent is preferably added in the range of 0.5 to 15% by mass based on the total mass of the solid content of the toner, and is more preferably added in the range of 0.5 to 10% by mass.

In the manufacturing method for the toner of the invention, particles, such as a charge control agent, inorganic particles, organic particles, a lubricant, and a polishing agent, can be added as required in addition to the above-mentioned dispersion liquid of resin particles, the magnetic powder-containing gelated product, the release agent dispersion liquid, and the like. As the method for addition, the particles may be dispersed into the dispersion liquid of binding resin particles, the coloring agent dispersion liquid, the release agent dispersion liquid, and the like, or a dispersion liquid prepared by dispersing the particles may be added into a mixed liquid prepared by mixing the dispersion liquid of binding resin particles, the coloring agent dispersion liquid, the release agent dispersion liquid, and the like, and then mixed.

The average particle diameter of the particles of these charge control agent, inorganic particles, organic particles, lubricant, polishing agent, and the like, is preferably 1 μm or less; and is more preferably 0.01 μm to 1 μm. If the average particle diameter exceeds 1 μm, the particle size distribution of the electrostatic latent image developing toner finally obtained may be broadened, or free particles may be easily generated, leading to degradation of the performance and reliability of the toner. In the present invention, by adjusting the average particle diameter to be in the range, the uneven distribution of the composition among the toner particles can be suppressed, and the non-uniformity of the toner performance and the reliability can be minimized.

The average particle diameter can be determined by using, for example, a laser diffraction type particle size distribution measuring apparatus, a centrifugal type particle size distribution measuring apparatus, or the like.

As described above, the dispersion liquid of resin particles, the magnetic powder-containing gelated product, and, as required, the release agent dispersion liquid, and the like are mixed, however, at that time, the pH of the dispersion liquid of resin particles is controlled such that the magnetic powder-containing gelated product is redispersed. At that time, the viscosity of the dispersion liquid is kept as high as possible to control precipitation of the magnetic powder.

Using the above-mentioned materials, in the aggregation process, the dispersion liquid comprising the dispersion liquid of binding resin particles, the magnetic powder-containing gelated product, the dispersion liquid of release agent particles, and the like, and prepared by adding other components as required, is stirred, while being heated in the temperature range from the room temperature to the glass transition temperature of the resin plus 5° C. or so, for aggregation of the resin particles and the magnetic powder, and the like to form aggregated particles.

In the aggregation process, the particles in the dispersion liquid of binding resin particles, the magnetic powder-containing gelated product, and the dispersion liquid of release agent particles added as required which are mixed with one another are aggregated to form aggregated particles. The aggregated particles are formed by the hetero aggregation, and the like, and can be formed by adding an ionic surfactant having a polarity different from that of the aggregated particles, and a compound, such as a metallic salt, or the like, having a monovalent or higher-valent charge for the purposes of stabilization of the aggregated particles and control of particle size/particle size distribution.

In the aggregation process, by changing the pH, aggregated particles can be generated, and the particle diameter of the particles can be adjusted. At the same time, as the method for stably and rapidly performing the aggregation of the particles, or obtaining aggregated particles having a narrower particle size distribution, an aggregation agent may be added.

As the aggregation agent, a compound having monovalent or polyvalent electric charges is preferable, and specific examples thereof include water soluble surfactants, such as ionic surfactants, nonionic surfactants; acids, such as hydrochloric acid, sulfuric acid, nitric acid, acetic acid, oxalic acid; metallic salts of inorganic acids, such as magnesium chloride, sodium chloride, aluminum sulfate, calcium sulfate, ammonium sulfate, aluminum nitrate, silver nitrate, copper sulfate, sodium carbonate; metallic salts of aliphatic acids or aromatic acids, such as sodium acetate, potassium formate, sodium oxalate, sodium phthalate, potassium salicylate; metallic salts of phenols, such as sodium phenolate; metallic salts of amino acids; inorganic acid salts of aliphatic or aromatic amines, such as triethanol amine hydrochloride, aniline hydrochloride.

The aggregation agents are more preferably inorganic or organic metallic salts, such as metallic salts of inorganic acids, such as magnesium chloride, sodium chloride, aluminum sulfate, calcium sulfate, ammonium sulfate, aluminum nitrate, silver nitrate, copper sulfate, sodium carbonate, and the like; metallic salts of aliphatic acids or aromatic acids, such as sodium acetate, potassium formate, sodium oxalate, sodium phthalate, potassium salicylate, and the like; and the like, and are still more preferably multivalent inorganic metallic salts, such as aluminum sulfate, aluminum nitrate, aluminum chloride, magnesium chloride, and the like, and the like; and inorganic metallic salt polymers, such as polyaluminum chloride, polyaluminum hydroxide, calcium polysulfide, and the like, which can be advantageously used because of the stability of the aggregated particles, the stability of the aggregation agent against heat and aging, the ease of removal in cleaning, and the like.

The amount of addition of these aggregation agents varies depending upon the valence of the charge, however, it is small, i.e., 3% by mass or less for monovalence, 1% by mass or less for divalence, and 0.5% by mass or less for trivalence, based on the amount of the binding resin particles. The amount of aggregation agent is preferably small, thus use of a polyvalent compound is preferable.

It is preferable that the volume average particle diameter of the aggregated particles be 1 μm to 4.5 μm.

In the present invention, in order to prevent the magnetic powder from being precipitated, the viscosity before forming the aggregated particles is kept at high value; in order to enhance the stirring efficiency in the stirring tank as required, optimization of the number of stirring rotations and geometry change of the stirring blades are performed; and further in order to prevent the stirring efficiency from being lowered, additional installation of a circulation type dispersing machine, and the like, is carried out for adjustment. Further, in the aggregation process, if an abrupt change in viscosity occurs, it is preferable to minimize the viscosity change by controlling the pH.

Thus, by using the carboxylic acid group-containing compound pertaining to the invention, precipitation of the magnetic powder particles is prevented, and the magnetic powder particles and the release agent particles are well dispersed with minimum exposure on the toner surface, which allows the magnetic powder to be uniformly dispersed, and as a result, toner particles stable in charge quantity to be manufactured.

In the fusion process after the aggregation process, the binding resin particles in the aggregated particles are fused at a temperature equal to or higher than the glass transition temperature of the binding resin, the shape of the aggregated particles being gradually changed from an amorphous one to a spherical one. At this time, the shape of the aggregated particles, which is amorphous, is becoming spherical by coalescence, and at the stage where a desired shape is obtained, the heating of the toner is stopped followed by cooling to form the toner particles.

In the present invention, the shape factor (SF1) of the toner is 110 to 140. By monitoring the shape during the coalescence, and raising the pH at the time when a shape factor in the range is obtained, the progressive change of the shape to the spherical one can be stopped.

In addition, between the aggregation process and the fusion process, a process (adhesion process), in which a dispersion liquid of particles prepared by dispersing particles is added into the dispersion liquid of aggregated particles for mixing to cause the particles to adhere to the aggregated particles to form adhered particles, can be provided.

In the adhesion process, a dispersion liquid of particles is added and mixing into the dispersion liquid of aggregated particles prepared in the aggregation process to cause the particles to adhere to the aggregated particles to form adhered particles. The particles added are particles which are newly added to the aggregated particles when viewed from the aggregated particles, thus, in the present specification, they may be stated as "added particles". The added particles may be release agent particles, coloring agent particles, and the like, as well as resin particles, which are provided alone or in combination. The method of adding and mixing the added particles is not particularly limited, and the addition may be gradually and continuously performed, or may be stepwisely performed in a plurality of times. By thus adding and mixing the added particles, generation of minute particles is suppressed, which can render the particle size distribution of the electrostatic latent image developing toner obtained sharp, contributing to a higher image quality.

In addition, by providing the adhesion process, a pseudo-shell structure can be formed, and the toner surface exposure of the internal additives, such as the coloring agent, the release agent, and the like, can be reduced, thus the charging characteristics and the service life of the carrier can be improved; and at the time of fusion in the fusion process, the particle size distribution can be maintained, and the fluctuation thereof can be suppressed, with the need for adding a stabilizer for enhancing the stability at the time of fusion, such as a surfactant, a base or an acid, being eliminated, or the amount of addition thereof being able to be minimized, which is advantageous in that the cost can be lowered and the quality can be improved. Further, this approach allows the toner shape control to be easily carried out through the adjustment of the temperature, the number of stirring cycles, the pH, and the like, in the fusion process.

In the manufacturing method for the toner of the invention, it is preferable that, as the dispersing agent, a surfactant, such as an anionic surfactant, a cationic surfactant, a nonionic surfactant, or the like, be further used in the above-mentioned respective dispersion liquids. Among these, it is more preferable that the anionic surfactant be used, because the anionic surfactant has high dispersive power, and is excellent in dispersibility of the binding resin particles, the coloring agent, and the like.

The nonionic surfactant is preferably used together with the anionic surfactant or the cationic surfactant. The surfactant may be used alone or in combination of two or more types.

Specific examples of the anionic surfactant include fatty acid soaps, such as potassium laurate, sodium oleate, caster oil sodium, and the like; sulfuric acid esters, such as octyl sulfate, lauryl sulfate, lauryl ether sulfate, nonylphenyl ether sulfate, and the like; alkylnaphthalene sulfonates, such as lauryl sulfonate, dodecylbenzene sulfonate, triisopropylnaphthalene sulfonate, dibutylnaphthalene sulfonate, and the like; sulfonates, such as naphthalene sulfonate formalin condensates, monooctyl sulfosuccinates, dioctyl sulfosuccinates, lauramide sulfonates, oleamide sulfonates, and the like; phosphoric acid esters, such as lauryl phosphate, isopropyl phosphate, nonylphenyl ether phosphate, and the like; dialkyl sulfosuccinates, such as dioctyl sodium sulfosuccinate; sulfosuccinates, such as disodium lauryl sulfosuccinate, and the like.

Specific examples of the cationic surfactant include amine salts, such as lauryl amine hydrochloride, stearyl amine hydrochloride, oleyl amine acetate, stearyl amine acetate, stearylaminopropyl amine acetate, and the like; quarternary ammonium salts, such as lauryltrimethyl ammonium chloride, dilauryldimethyl ammonium chloride, distearyldimethyl ammonium chloride, lauryl dihydroxy ethylmethyl ammonium chloride, oleyl bis polyoxyethylenemethyl ammonium chloride, lauroyl aminopropyl dimethylethyl ammonium ethsulfate, lauroyl aminopropyl dimethylhydroxyethyl ammonium perchlorate, alkylbenzene trimethyl ammonium chloride, alkyltrimethyl ammonium chloride, and the like.

Specific examples of the nonionic surfactant include alkyl ethers, such as polyoxyethylene octyl ether, polyoxyethylene lauryl ether, polyoxyethylene stearyl ether, polyoxyethylene oleyl ether, and the like; alkyl phenyl ethers, such as polyoxyethylene octylphenyl ether, polyoxyethylene nonylphenyl ether, and the like; alkyl esters, such as polyoxyethylene laurate, polyoxyethylene stearate, polyoxyethylene olate, and the like; alkyl amines, such as polyoxyethylene lauryl amino ether, polyoxyethylene stearyl amino ether, polyoxyethylene oleyl amino ether, polyoxyethylene soy bean amino ether, polyoxyethylene beef tallow amino ether, and the like; alkyl amides, such as polyoxyethylene lauramide, polyoxyethylene stearamide, polyoxyethylene oleamide, and the like; vegetable oil ethers, such as polyoxyethylene caster oil ether, polyoxyethylene rapeseed oil ether, and the like; alkanol amides, such as lauric acid diethanol amide, stearic acid diethanol amide, oleic acid diethanol amide, and the like; sorbitan ester ethers, such as polyoxyethylene sorbitan monolaurate, polyoxyethylene sorbitan monopalmiate, polyoxyethylene sorbitan monostearate, polyoxyethylene sorbitan monooleate, and the like.

The content of the surfactant in the respective dispersion liquids is generally low; specifically, it is preferably 0.01 to 10% by mass; is more preferably 0.05 to 5% by mass; and is still more preferably 0.1 to 2% by mass. If the content is under 0.01% by mass, the dispersion of the respective dispersion liquids, such as the dispersion liquid of binding resin particles, the coloring agent dispersion liquid, the release agent dispersion liquid, and the like, is unstable, thus there may arise problems, such as aggregation occurring, specific particles being liberated due to the difference in stability between respective particles in the aggregation, and the like; and if the content exceeds 10% by mass, the particle size distribution of the particles may be broadened, or the control of the particle diameter may be difficult.

In addition, as the surfactant, aqueous polymers which are solid at normal temperature can also be used. Specifically, cellulose compounds, such as carboxymethyl cellulose, hydroxypropyl cellulose, and the like; polyvinyl alcohol, gelatine, starch, arabic gum, and the like can be used.

The aggregated particles thus formed are subjected to a heating treatment at a temperature equal to or higher than the glass transition temperature of the resin for fusion of the aggregated particles to obtain a toner particle-containing liquid (a dispersion liquid of toner particles), which is then cooled. Then the toner particle-containing liquid obtained is treated by centrifugal separation or suction filtering to separate the toner particles, which are cleaned with ion-exchange water 1 to 3 times. At that time, by adjusting the pH, the cleaning effect can be enhanced. Thereafter, the toner particles are filtered out, cleaned with ion-exchange water 1 to 3 times, and dried to obtain the toner.

For the toner of the present invention, various types of resin powder and inorganic compound can be used as the external additive to the surface of the toner particles for improving the fluidity. As the resin powder, spherical particles made of such a material as PMMA, nylon, melamine, benzoguanamine, and fluorine resin can be used. Various known examples of the inorganic compound include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $CaCO_3$, $K_2O(TiO_2)_n$, $MgCO_3$, $Al_2O_3.2SiO_2$, $BaSO_4$, $MgSO_4$, and the like, and preferably $SiO_2$, $TiO_2$, and $Al_2O_3$ can be mentioned, however, the inorganic compound is not limited to these, and these inorganic compounds may be used alone or in combination of two or more types. In addition, the particle diameter is preferably 0.1 μm or smaller, and the external additive used can be added in the range of 0.1 to 20% by mass based on the mass of the toner particles.

<Electrostatic Latent Image Developing Developer>

The electrostatic latent image developing developer of the present invention comprises at least a toner, wherein the toner is the above-mentioned electrostatic latent image developing toner of the present invention.

In the electrostatic latent image developing developer of the present invention, the component composition can be selected in accordance with the purpose. The toner can be used alone as an electrostatic latent image developing developer having a single component, or can be used in combination with a carrier as an electrostatic latent image developing developer having two components.

The carrier to be used herein is not particularly limited, and a known carrier can be used.

As a specific example of the carrier, a resin-coated carrier will be described below. As a nuclear particle (core material) for the carrier, general iron powder, ferrite, and magnetite shapes, and the like can be used, and it is preferable that the volume average particle diameter D50v thereof be 30 μm to 200 μm.

As the coating resin for the nuclear particle, examples include styrenes, such as styrene, parachlorostyrene, α-methylstyrene, and the like; α-methylene fatty acid monocarboxylic acids, such as methyl acrylate, ethyl acrylate, n-propyl acrylate, lauryl acrylate, 2-ethylhexyl acrylate, methyl methacrylate, n-propyl methacrylate, lauryl methacrylate, 2-ethylhexyl methacrylate, and the like; nitrogen-containing acryls, such as dimethylaminoethyl methacrylate and the like; vinyl nitriles, such as acrylonitrile, methacrylonitrile, and the like; vinylpyridines, such as 2-vinylpyridine, 4-vinylpyridine, and the like; vinyl ethers, such as vinyl methyl ether, vinyl isobutyl ether, and the like; vinyl ketones, such as vinyl methyl ketone, vinyl ethyl ketone, vinyl isopropenyl ketone, and the like; olefins, such as ethylene, propylene, and the like; homopolymers or copolymers which consist of two or more types of monomer, of fluorine-containing vinyl monomers, such as vinylidene fluoride, tetrafluoroethylene, hexafluoroethylene, and the like; further, silicones, such as methyl silicone, methyl phenyl silicone, and the like; polyesters containing bisphenol, glycol, and the like; an epoxy resin, a polyurethane resin, a polyamide resin, a cellulosic resin, a polyether resin, a polycarbonate resin, and the like.

These coating resins may be used alone or in combination of two or more types. The amount of the coating resin used is preferably 0.1 to 10 parts by mass based on 100 parts by mass of the nuclear particle, and is more preferably 0.5 to 3.0 parts by mass.

For manufacture of the carrier, a heating type kneader, a heating type Henschel mixer, UM mixer, and the like, can be used, and depending on the amount of the coating resin, a heating type fluidized rotary bed, a heating type kiln, and the like, can be used. The mixture ratio of the toner to the carrier in the developer to be used in the present invention is not particularly limited, and can be appropriately selected in accordance with the purpose.

In the present invention, the magnetic powder in the toner allows the toner to be carried on the toner carrier with the magnetic force, thus it is preferable to use the toner as an electrostatic latent image developing developer having one component, with which the transportability of the toner and the fogging of the toner on non-image portions can be easily suppressed.

<Image Forming Method>

The image forming method of the present invention using the above-mentioned electrostatic latent image developing developer of the present invention is an image forming method comprising the steps of forming an electrostatic latent image on the surface of an electrostatic latent image carrier;

developing the formed electrostatic latent image with an electrostatic latent image developer to form a toner image; transferring the formed toner image onto the surface of a recording medium; and thermally fixing the transferred toner image, wherein the electrostatic latent image developer is the electrostatic latent image developing developer of the present invention.

The respective steps are general ones, and are mentioned in, for example, Japanese Laid-Open Publication No. 56-40868/1981, Japanese Laid-Open Publication No. 49-41231/1974, and the like, being advantageously applicable in the present invention. The image forming method of the present invention can be implemented with a known image forming apparatus, such as a copying machine, a printer, a facsimile, a compound machine thereof, or the like.

As the fixing apparatus to be used in the image forming method of the present invention, a known fixing apparatus can be used. It is preferable that the heating member of the fixing apparatus be provided with a releasing layer. The releasing layer is preferably formed of a material excellent in releasability with respect to the toner, such as silicone rubber, a fluorine resin, or the like, in order to prevent the toner from adhering thereto. As specific examples of the fluorine resin, a copolymer of tetrafluoro ethylene and perfluoro alkyl vinyl ether, a copolymer of tetrafluoro ethylene and ethylene, and a copolymer of tetrafluoro ethylene and hexafluoro ethylene can be preferably mentioned. The thickness of the releasing layer can be appropriately selected for the purpose, however, it is preferably 10 μm to 60 μm.

In the toner configuration in the image forming method of the present invention, there is no need for use of a releasing liquid to be applied to the heating member, such as silicone oil, or the like, when the release agent is contained in the toner, however, the releasing liquid may be used by 1 μL or less, or so, per A4-size paper for such a purpose as securing the high-temperature fixing area.

EXAMPLES

The present invention will be more specifically described with the following EXAMPLES and COMPARATIVE EXAMPLES, however, the present invention is not limited to the EXAMPLES.

First, the toners which are used in the EXAMPLES and COMPARATIVE EXAMPLES will be specifically described. Unless otherwise noted, the term "part" means "part by mass", and "%" means "% by mass".

Here is a description of the particle size distribution determination method in the EXAMPLES. As the measuring apparatus, a Coulter counter Model TAII (manufactured by Beckman Coulter, Inc.) is used, and as the electrolyte, ISOTON-II (manufactured by Beckman Coulter, Inc.) is used.

The determination method is as follows: 0.5 mg to 50 mg of the test sample is added into 2 mL of 5% aqueous solution of a surfactant as the dispersing agent (preferably sodium alkylbenzenesulfonate). This solution is added into 100 mL to 150 mL of the electrolyte. The electrolyte in which the sample is suspended is dispersion-treated for approx. 1 min by means of an ultrasonic wave disperser, and by using the Coulter counter Model TAII, the particle size distribution of the particles of 0.6 μm to 18 μm is determined with an aperture of 30 μm as the aperture diameter to find the volume-average distribution and the number-average distribution. The number of particles under test is specified to be 50,000. From the volume-average distribution and the number-average distribution determined, the volume-average particle diameter is obtained.

The toner particle size distribution can be represented by the particle size distribution index (GSD), which can be expressed by the following formula:

$$GSD=[(d16/d84)]^{0.5}$$

In the above formula, d16, d50, and d84 denote the particle diameter at 16%, 50%, and 84% of the particles counted from the side of the greater particle size, respectively, wherein values thereof shows d16>d50>d84. It can be said that the smaller the GSD, the more uniform the toner particle size. As the GSD, that calculated from the number-average particle diameters and that from the volume average particle diameters are available, however, herein, the latter is adopted as the GSD for toner.

The range of the GSD is preferably 1.25 or less, more preferably, it is 1.22 or less, and still more preferably, it is 1.20 or less. If the GSD is over 1.25, the image quality is deteriorated, and also the service life of the carrier is shortened due to the increase of minute particles.

The average particle diameters of the binding resin particles, the coloring agent particles, and the release agent particles are volume-average particle diameters measured by using a laser diffraction type particle size distribution measuring apparatus (LA-700, manufactured by HORIBA, ltd.).

The weight-average molecular weight and the number-average molecular weight are determined under the following conditions. As the GPC (gel permeation chromatography) apparatus, an HLC-8120GPC, SC-8020 (manufactured by TOSOH CORPORATION) is used; two TSKgel, Super HM-H columns (manufactured by TOSOH CORPORATION, with 6.0 mm ID×15 cm) are used; and as the eluent, THF (tetrahydrofran) is used. As the experimental conditions, a sample concentration of 0.5%, a flow rate of 0.6 ml/min, a sample injection amount of 10 μL, a measuring temperature of 40° C., and an IR detector are used for experiment. The calibration curve is prepared from ten samples of the TOSOH CORPORATION Polystyrene Standard Sample TSK standards: A-500, F-1, F-10, F-80, F-380, A-2500, F-4, F-40, F-128, and F-700.

The glass transition point of the binding resin particles is determined by using a differential scanning calorimeter (DSC-50, manufactured by Shimadzu Corporation) under the condition of a temperature rise rate of 3° C./min.

The shape factor (SF1) of the toner in the present invention is the average value of the shape factors that are determined by taking the optical microscope image of the 500 or more toner particles scattered on a slide glass into a Luzex image analyzing apparatus through a video camera, and using the following formula:

$$\text{Shape factor } (SF1)=(ML^2/A)\times(\pi/4)\times 100$$

(ML denotes the circumferential length of toner particle, and A the projected area.)

First, various types of dispersion liquid are prepared as follows:

(Preparation of Dispersion Liquid of Resin Particles (1))

Styrene: 280 parts
n-butylacrylate: 100 parts
Acrylic acid: 4 parts
Dodecyl mercaptan: 10 parts
Carbon tetrabromide: 3 parts The above-mentioned components are previously mixed to be dissolved for preparation of a solution, and a surfactant solution dissolving 7 parts of a nonionic surfactant (NONIPOL, manufactured by Sanyo Chemical Industries, Ltd.) and 10 parts of an anionic surfactant (Neogen RK, manufactured by DAI-ICHI KOGYO SEIYAKU CO., LTD.) in 520 parts of ion-exchange water, and the solution are charged into a flask for emulsification. While slowly mixing for 10 min, 70 parts of ion-exchange water dissolving 3 parts of ammonium persulfate is further charged, and nitrogen substitution is carried out. Thereafter, while stirring, the flask is heated in an oil bath until the contents are at 70° C., and as they are, emulsification polymerization is continued for 6 hr. Thereafter, this reaction solution is cooled to the room temperature to obtain a dispersion liquid of resin particles (1) having an average particle diameter of 150 nm, a glass transition point of 58.0° C., a weight average molecular weight of 25,000, and an Mw/Mn ratio of 2.5.

(Preparation of Carboxylic Acid Group-Containing Compound Dispersion Liquid (1))

Aqueous ammonia is added into a styrene-maleic acid copolymer GSM601 (manufactured by Gifu Shellac Mfg. Co., Ltd., with an Mw of 6000 and an acid value of 470) to be dissolved while heating, and by adjusting the resin concentration to be 30%, a carboxylic acid group-containing compound dispersion liquid (1) having a pH of 8.2 is obtained.

(Preparation of Carboxylic Acid Group-Containing Compound Dispersion Liquid (2))

Aqueous ammonia is added into a styrene-maleic acid copolymer GSM605 (manufactured by Gifu Shellac Mfg. Co., Ltd., with an Mw of 6000 and an acid value of 180) to be dissolved while heating, and by adjusting the resin concentration to be 30%, a carboxylic acid group-containing compound dispersion liquid (2) having a pH of 8.0 is obtained.

(Preparation of Carboxylic Acid Group-Containing Compound Dispersion Liquid (3))

Aqueous ammonia is added into a styrene-maleic acid copolymer esterified product SMA1440A (manufactured by Elf Atochem S.A., with an Mw of 2500 and an acid value of 185) to be dissolved while heating, and by adjusting the resin concentration to be 30%, a carboxylic acid group-containing compound dispersion liquid (3) having a pH of 8.1 is obtained.

(Preparation of Carboxylic Acid Group-Containing Compound Dispersion Liquid (4))

Aqueous ammonia is added into a α-methyl styrene-acrylic acid copolymer GSA502 (manufactured by Gifu Shellac Mfg. Co., Ltd., with an Mw of 5000 and an acid value of 300) to be dissolved while heating, and by adjusting the resin concentration to be 30%, a carboxylic acid group-containing compound dispersion liquid (4) having a pH of 8.1 is obtained.

(Preparation of Carboxylic Acid Group-Containing Compound Dispersion Liquid (5))

Aqueous ammonia is added into a styrene-maleic acid copolymer GSM151 (manufactured by Gifu Shellac Mfg. Co., Ltd., with an Mw of 1500 and an acid value of 470) to be dissolved while heating, and by adjusting the resin concentration to be 30%, a carboxylic acid group-containing compound dispersion liquid (5) having a pH of 8.2 is obtained.

(Preparation of Carboxylic Acid Group-Containing Compound Dispersion Liquid (6))

Aqueous ammonia is added into a styrene-maleic acid copolymer esterified product SMA3840A (manufactured by Elf Atochem S.A., with an Mw of 2300 and an acid value of 110) to be dissolved while heating, and by adjusting the resin concentration to be 30%, a carboxylic acid group-containing compound dispersion liquid (6) having a pH of 8.1 is obtained.

(Preparation of Carboxylic Acid Group-Containing Compound Dispersion Liquid (7))

Aqueous ammonia is added into a styrene-maleic acid copolymer GSM6001 (manufactured by Gifu Shellac Mfg. Co., Ltd., with an Mw of 60,000 and an acid value of 500) to be dissolved while heating, and by adjusting the resin concentration to be 30%, a carboxylic acid group-containing compound dispersion liquid (7) having a pH of 8.2 is obtained.

(Preparation of Magnetic Powder-Containing Gelated Product (1))

EPT305 (250-nm ferrite, manufactured by TODA KOGYO CORP.): 50 parts

Carboxylic acid group-containing compound dispersion liquid (1): 10 parts

Ion-exchange water: 40 parts

After mixing the above-mentioned components, a homogenizer (Ultra-Tarrax, manufactured by IKA Labortechnik GmbH) is used for carrying out dispersion to obtain a magnetic powder dispersion liquid (1) in which magnetic powder having an average particle diameter of 260 nm is dispersed. While stirring the dispersion liquid, the pH is lowered with nitric acid until it is impossible to stir due to the gelation. By dipping up a part with a spatula to check to make sure that the shape of the dipped-up portion can be maintained, a magnetic powder-containing gelated product (1) is obtained.

(Preparation of Magnetic Powder-Containing Gelated Product (2))

A magnetic powder-containing gelated product (2) is obtained in the same manner as in preparation of the magnetic powder-containing gelated product (1), except that the carboxylic acid group-containing compound dispersion liquid (2) is substituted for the carboxylic acid group-containing compound dispersion liquid (1).

(Preparation of Magnetic Powder-Containing Gelated Product (3))

A magnetic powder-containing gelated product (3) is obtained in the same manner as in preparation of the magnetic powder-containing gelated product (1), except that the carboxylic acid group-containing compound dispersion liquid (3) is substituted for the carboxylic acid group-containing compound dispersion liquid (1).

(Preparation of Magnetic Powder-Containing Gelated Product (4))

A magnetic powder-containing gelated product (4) is obtained in the same manner as in preparation of the magnetic powder-containing gelated product (1), except that the carboxylic acid group-containing compound dispersion liquid (4) is substituted for the carboxylic acid group-containing compound dispersion liquid (1).

(Preparation of Magnetic Powder-Containing Product (5))

Although not sufficiently gelated, a magnetic powder-containing product (5) is obtained in the same manner as in preparation of the magnetic powder-containing gelated product (1), except that the carboxylic acid group-containing compound dispersion liquid (5) is substituted for the carboxylic acid group-containing compound dispersion liquid (1).

(Preparation of Magnetic Powder-Containing Gelated Product (6))

A magnetic powder-containing gelated product (6) is obtained in the same manner as in preparation of the magnetic powder-containing gelated product (1), except that the carboxylic acid group-containing compound dispersion liquid (6) is substituted for the carboxylic acid group-containing compound dispersion liquid (1).

(Preparation of Magnetic Powder-Containing Gelated Product (7))

A magnetic powder-containing gelated product (7) is obtained in the same manner as in preparation of the magnetic powder-containing gelated product (1), except that the carboxylic acid group-containing compound dispersion liquid (7) is substituted for the carboxylic acid group-containing compound dispersion liquid (1).

(Preparation of a Release Agent Dispersion Liquid (1))

Polyethylene wax (with a melting point of 109° C. and a degree of crystallization of 67): 100 parts Anionic surfactant (Pionine A45-D, manufactured by TAKEMOTO OIL & FAT CO., LTD.): 2 parts Ion-exchange water: 400 parts After mixing the above-mentioned components, a homogenizer (Ultra-Tarrax, manufactured by IKA Labortechnik GmbH) is used for carrying out dispersion, and then a high-pressure discharge type homogenizer is used for dispersion treatment to prepare a release agent dispersion liquid (1) in which a release agent (polyethylene wax) having an average particle diameter of 280 nm is dispersed.

Example 1

(Manufacture of Toner A)

dispersion liquid of resin particles (1): 250 parts

Magnetic powder-containing gelated product (1): 300 parts

Release agent dispersion liquid (1): 100 parts

Polyaluminum chloride: 2 parts

Ion-exchange water: 400 parts

After the dispersion liquid of resin particles (1) is placed in a round-bottom flask made of stainless steel, and the pH is adjusted to be 6.0, the remaining respective components are added; a homogenizer (Ultra-Tarrax T50, manufactured by IKA Labortechnik GmbH) is used for carrying out mixing and dispersion; then while stirring in an oil bath for heating, the solution is heated; and while the pH is adjusted such that the viscosity of the dispersion liquid is not varied, the solution is heated to 60° C., and held for 30 min to form aggregated particles. Observation of a part of the aggregated particles with an optical microscope reveals that the average particle diameter of the aggregated particles is approx. 4.5 μm. To this aggregated particle solution, 30 parts of the dispersion liquid of resin particles (1) is slowly further added, and the solution is heated for 30 min at 60° C. with stirring to obtain an aggregated particle liquid (A). The average particle diameter of the aggregated particles in the aggregated particle liquid obtained is approx. 5.4 μm.

Then, after the pH being adjusted to 7.5 with aqueous ammonia, the liquid is heated to 97° C., and is held for 7 hr as it is, in order to cause the aggregated particles to be fused with one another. Thereafter, they are cooled, filtered, and sufficiently cleaned with ion-exchange water, and the volume average particle diameter D50v of the fused particles is determined with a Coulter counter to be found to be 5.3 μm. By drying the fused particles with a vacuum drying machine, a toner A is obtained. The shape factor (SF1) of the toner is 125.0.

(Manufacture of Developer A)

To 100 parts of the toner A obtained, 0.5 parts of a hydrophobic silica (TS720F, manufactured by Cabot Corporation) is added, and these are mixed with each other by using a Henschel mixer to obtain an electrostatic latent image developing toner. And, to a ferrite carrier having a volume average particle diameter D50v of 45 μm that is coated with polymethylmethacrylate (manufactured by Soken Chemical & Engineering Co., Ltd.) by 1% by mass, the toner is weighed into a glass bottle such that the toner concentration is 5% by mass, and both are mixed with each other in a ball mill for 5 min to obtain a developer A.

(Evaluation of Charge Retention Rate)

The charge retention rate is determined as follows: Measurement with respect to the developer A is carried out by using TB-200 (manufactured by Toshiba Chemical Corporation) within 30 min after the manufacture thereof (to obtain a measurement value A), and then after the same developer being left in an isothermal humidistat at 35° C. and 85% RH for approx. 12 hr, measurement is again carried out (to obtain a measurement value B). The measurement value B/the measurement value A is defined as the charge retention rate. Table 1 gives the value thereof. If the charge retention rate is lower than 0.7, an image deterioration, such as fogging, or the like, may be caused when printing at a high temperature and a high humidity.

(Evaluation of Image Stability)

With the use of the developer A obtained and a modified Laser Press 4161, an image is outputted onto a recording paper (J paper, manufactured by Fuji Xerox Office Supply Co., Ltd), and a running test for 10,000 sheets at 23° C. and 55% RH, and that for 10,000 sheets at 28° C. and 85% RH are conducted to observe the image stability. The image stability is evaluated by the following criteria. The result is as given in Table 1. The image formation with the modified Laser Press 4161 is an image formation comprising the latent image formation step, the development step, the transfer step, and the fixing step. In Table 1, when "B" or "C" is followed by parentheses, only the change mentioned in the parentheses is observed.

A: There are only slight changes in printing density and image quality depending on the environment, and the result is thus good.

B: There is a change in printing density or image quality depending on the environment, but is no problem for use.

C: There are clearly changes in printing density and/or image quality depending on the environment, and the picture image quality is also poor.

Example 2

(Manufacture of Toner B, Manufacture of Developer B, and Image Formation and Evaluation)

The toner B and the developer B are manufactured in the same manner as in EXAMPLE 1, except that the magnetic powder-containing gelated product (2) is substituted for the magnetic powder-containing gelated product (1). By using the developer B obtained, the image stability is evaluated in the same manner as in EXAMPLE 1. Table 1 gives the result.

Example 3

(Manufacture of Toner C, Manufacture of Developer C, and Image Formation and Evaluation)

The toner C and the developer C are manufactured in the same manner as in EXAMPLE 1, except that the magnetic powder-containing gelated product (3) is substituted for the magnetic powder-containing gelated product (1). By using the developer C obtained, the image stability is evaluated in the same manner as in EXAMPLE 1. Table 1 gives the result.

Example 4

(Manufacture of Toner D, Manufacture of Developer D, and Image Formation and Evaluation)

The toner D and the developer D are manufactured in the same manner as in EXAMPLE 1, except that the magnetic powder-containing gelated product (4) is substituted for the magnetic powder-containing gelated product (1). By using the developer D obtained, the image stability is evaluated in the same manner as in EXAMPLE 1. Table 1 gives the result.

Comparative Example 1

(Manufacture of Toner E, Manufacture of Developer E, and Image Formation and Evaluation)

The toner E and the developer E are manufactured in the same manner as in EXAMPLE 1, except that the magnetic powder-containing product (5) is substituted for the magnetic powder-containing gelated product (1). By using the developer E obtained, the image stability is evaluated in the same manner as in EXAMPLE 1. Table 1 gives the result.

Comparative Example 2

(Manufacture of Toner F, Manufacture of Developer F, and Image Formation and Evaluation)

The toner F and the developer F are manufactured in the same manner as in EXAMPLE 1, except that the magnetic powder-containing gelated product (6) is substituted for the magnetic powder-containing gelated product (1). By using the developer F obtained, the image stability is evaluated in the same manner as in EXAMPLE 1. Table 1 gives the result.

Comparative Example 3

(Manufacture of Toner C Manufacture of Developer C and Image Formation and Evaluation)

The toner G and the developer G are manufactured in the same manner as in EXAMPLE 1, except that the magnetic powder-containing gelated product (7) is substituted for the magnetic powder-containing gelated product (1). By using the developer G obtained, the image stability is evaluated in the same manner as in EXAMPLE 1. Table 1 gives the result.

Comparative Example 4

(Manufacture of Toner H, Manufacture of Developer H, and Image Formation and Evaluation)

The toner H and the developer H are manufactured in the same manner as in EXAMPLE 1, except that the time period for fusion is specified to be 1 hr, although the formulation used is the same as that in EXAMPLE 1. By using the developer H obtained, the image stability is evaluated in the same manner as in EXAMPLE 1. Table 1 gives the result.

Comparative Example 5

(Manufacture of Toner I, Manufacture of Developer I, and Image Formation and Evaluation)

The toner I and the developer I are manufactured in the same manner as in EXAMPLE 1, except that the temperature for fusion is specified to be 105° C., and the time period for fusion is specified to be 10 hr, although the formulation used is the same as that in EXAMPLE 1. By using the developer I obtained, the image stability is evaluated in the same manner as in EXAMPLE 1. Table 1 gives the result.

TABLE 1

| | Carboxylic acid group-containing compound | | | | | | |
|---|---|---|---|---|---|---|---|
| | Weight-average molecular weight | Acid value (mg KOH/g) | Shape factor (SF1) | Volume-average particle dia. (μm) | GSD | Charge retention rate | Image stability |
| EXAMPLE 1 | 6000 | 470 | 125.0 | 5.3 | 1.22 | 0.84 | A |
| EXAMPLE 2 | 6000 | 180 | 126.2 | 5.4 | 1.21 | 0.89 | A |
| EXAMPLE 3 | 2500 | 185 | 124.5 | 5.3 | 1.22 | 0.89 | A |
| EXAMPLE 4 | 5000 | 300 | 127.0 | 5.3 | 1.23 | 0.88 | A |
| COMPAR. EXAMPLE 1 | 1500 | 470 | 124.0 | 5.2 | 1.21 | 0.58 | B (image quality) |
| COMPAR. EXAMPLE 2 | 2300 | 110 | 127.2 | 5.3 | 1.22 | 0.52 | B (image quality) |
| COMPAR. EXAMPLE 3 | 60000 | 500 | 129.0 | 5.8 | 1.30 | 0.44 | C |
| COMPAR. EXAMPLE 4 | 6000 | 470 | 145.0 | 5.8 | 1.30 | 0.80 | C (fogging) |
| COMPAR. EXAMPLE 5 | 6000 | 470 | 105.0 | 5.8 | 1.30 | 0.82 | C (poor cleaning) |

From Table 1, it can be seen that, in EXAMPLES 1 to 4, no changes in printing density and image quality depending on the environment are caused.

As described above, the present invention can provide an electrostatic latent image developing toner in which magnetic powder is uniformly dispersed and which is excellent in charging characteristics and image stability, a manufacturing method thereof, an electrostatic latent image developing developer, and an image forming method.

What is claimed is:

1. An electrostatic latent image developing toner comprising a binding resin having an acidic polar group, a gelated carboxylic acid group-containing compound in which a magnetic powder is dispersed, the toner having a shape factor (SF1) of 110 to 140, wherein the carboxylic acid group-containing compound has a weight-average molecular weight, excluding the magnetic powder, of 1800 to 50,000 and an acid value of 200 to 500 mg KOH/g; and a solid content amount, excluding the magnetic powder, of the carboxylic acid group-containing compound is 0.5 to 30.0% by mass based on a solid content amount of the magnetic powder.

2. The electrostatic latent image developing toner of claim 1, wherein the binding resin'has a carboxylic acid group.

3. The electrostatic latent image developing toner of claim 1, wherein the binding resin is a vinyl resin.

4. The electrostatic latent image developing toner of claim 1, wherein the binding resin has a glass transition point of 40° C. to 70° C.

5. The electrostatic latent image developing toner of claim 1, wherein the binding resin has a weight-average molecular weight of 6000 to 45,000.

6. The electrostatic latent image developing toner of claim 1, wherein the ratio (Mw/Mn) of the weight-average molecular weight to the number-average molecular weight of the binding resin is 3.3 or lower.

7. The electrostatic latent image developing toner of claim 1, further comprising a release agent, wherein the content of the release agent is 6 to 25% by mass based on the total mass of the toner.

8. The electrostatic latent image developing toner of claim 1, wherein an external additive is added onto the surface of the toner particles, and the amount of the external additive is 0.1 to 20% by mass based on the mass of the toner particles.

9. An electrostatic latent image developing developer comprising a toner, wherein the toner is the electrostatic latent image developing toner of claim 1.

10. The electrostatic latent image developing toner of claim 1, wherein the carboxylic acid group-containing compound has an acid value of 250 to 400 mg KOH/g.

11. The electrostatic latent image developing developer of claim 9, wherein the carboxylic acid group-containing compound has an acid value of 250 to 400 mg KOH/g.

* * * * *